US005988907A

United States Patent [19]

Iso

[11] Patent Number: 5,988,907

[45] Date of Patent: Nov. 23, 1999

[54] PAPER TRANSPORT DEVICE FOR COLOR THERMAL PRINTER

[75] Inventor: Masato Iso, Saitama, Japan

[73] Assignee: Fuji Photo Film Co., Ltd., Kanagawa, Japan

[21] Appl. No.: 08/975,320

[22] Filed: Nov. 21, 1997

[30] Foreign Application Priority Data

Nov. 21, 1996 [JP] Japan ..... 8-310791
Oct. 8, 1997 [JP] Japan ..... 9-275596

[51] Int. Cl.[6] ..... B41J 13/02; B41J 13/10

[52] U.S. Cl. ..... 400/637; 400/636; 400/642

[58] Field of Search ..... 400/613, 636, 400/637, 637.1, 637.2, 637.3, 637.4, 637.5, 637.6, 638, 639, 642, 645, 645.3, 645.4; 347/218, 219

[56] References Cited

U.S. PATENT DOCUMENTS

| | | | |
|---|---|---|---|
| 4,491,854 | 1/1985 | Habelt et al. | 400/637.5 |
| 4,500,219 | 2/1985 | Lange et al. | 400/637 |
| 4,606,663 | 8/1986 | Christoph et al. | 400/636 |
| 5,011,314 | 4/1991 | Fujii | 400/642 |
| 5,056,944 | 10/1991 | Gillio | 400/637 |
| 5,092,690 | 3/1992 | Grimm et al. | 400/642 |
| 5,186,556 | 2/1993 | Koyanagi | 400/642 |

FOREIGN PATENT DOCUMENTS

| | | | |
|---|---|---|---|
| 0 294 793 | 12/1988 | European Pat. Off. | 400/642 |
| 0420400 | 4/1991 | European Pat. Off. | 400/642 |
| 6-1022 | 1/1994 | Japan | 400/642 |

OTHER PUBLICATIONS

IBM Technical Disclosure Bulletin Vo. 21, No. 2, "Document Entry Mechanism . . . ", Jul. 1978.

*Primary Examiner*—Christopher A. Bennett
*Attorney, Agent, or Firm*—Birch, Stewart, Kolasch & Birch, LLP

[57] ABSTRACT

A transport roller device of a color thermal printer is constituted of a capstan roller and a main press roller for nipping recording paper therebetween and transporting the recording paper selectively in opposite directions. The transport roller device further has a supplemental guide member for keeping the recording paper in contact with a peripheral surface of the capstan roller through a constant angle in either transporting direction, thereby to maintain paper transporting amount per a rotational angle of the capstan roller unchanged.

15 Claims, 11 Drawing Sheets

PAPER TRANSPORT DEVICE FOR COLOR THERMAL PRINTER

BACKGROUND OF THE INVENTION

1. Field of the Invention

The present invention relates to a color thermal printer for recording a full-color image in a frame sequential fashion. More particularly, the present invention relates to a paper transport device for a color thermal printer, wherein recording paper is transported alternately in a recording direction and in the opposite direction through a single thermal head, and one color frame is recorded during one transport of the recording paper in the recording direction.

2. Background Arts

In a color thermal printer, at least three color frames are sequentially recorded in a recording area on the recording paper. To prevent color failure, accurate registration between the color frames is necessary, so the positioning of the recording area relative to a heating element array of the thermal head should also be accurate. Especially in a color thermal printer where the recording paper is transported repeatedly through a single thermal head, it is necessary to control the paper transport amount relative to the thermal head with high accuracy. For this reason, a transport roller device consisting of a capstan roller and a press roller is disposed in proximity to the thermal head in this type of color thermal printer. For more accurate and stable paper transport, it has been suggested to turn the recording paper around the capstan roller.

As an array of heating elements of the thermal head is directly or indirectly pressed onto the recording paper while heating the recording paper, the recording paper is heat-deformed or curled to some extent. Particularly where the recording paper turns around the capstan roller, the curl becomes so large that it can cause variation in transport amount of the recording paper per a rotational angle of the capstan roller. Especially in a color thermal printer having a single thermal head, as the color recording paper is heated at least three times for recording three color frames, the degree of curling increases gradually.

Because thermosensitive color recording paper has coloring layers sequentially overlaid on a support material, and the bottom coloring layer nearest to the support material has the lowest heat sensitivity, the bottom coloring layer is recorded at last with the largest heat energy among these coloring layers. Consequently, the degree of curling is getting larger as the recording proceeds. The more the recording paper curls, the more the transporting amount per a rotational angle of the capstan roller varies. In addition, the support material of the thermosensitive color recording paper is so stiff that it amplifies the influence of curling on the transporting amount by the capstan roller.

Moreover, it is necessary for the thermosensitive color recording paper to optically fix or deactivate the top and second from the top coloring layers after each recording of corresponding color frames, so as not to develop color any more during the next color recording. In a thermosensitive-type printer where optical fixing lamps for the two colors are provided side by side along a paper transport path, the thermosensitive recording paper is transported by a different amount for the optical fixing of one color from the other color, in order to exposure the same recording area to the light of each fixing lamp. The difference in the transport amount necessary for the optical fixing of one color from the other makes it difficult to measure the variation in the transporting amount of the curled recording paper by the capstan roller.

SUMMARY OF THE INVENTION

In view of the foregoing, a prime object of the present invention is to reduce the influence of curling of the recording paper on the transporting amount by the capstan roller to a minimum, and thus achieve a highly accurate positioning of a recording area to a thermal head in a color thermal printer wherein the recording paper is transported alternately in opposite directions, and the single thermal head records one color frame in the recording area during one transport of the recording paper in one transporting direction.

To achieve the above object, a color thermal printer according to the present invention is provided with a supplemental guide member in addition to a press roller for pressing the recording paper onto a capstan roller and rotating together with the capstan roller to transport the recording paper. The supplemental guide member is disposed around the capstan roller, so as to keep the recording paper in contact with a peripheral surface of the capstan roller through a constant angle in either transporting direction. Thereby, paper transporting amount per a rotational angle of the capstan roller is maintained unchanged.

According to a preferred embodiment, the supplemental guide member includes at least a roller or a guide plate which is placed away from the capstan roller and before or after the press roller. According to another preferred embodiment, the supplemental guide members includes a pair of rollers or guide plates placed before and after the press roller, at least one of which is placed away from the capstan roller.

According to another preferred embodiment, the supplemental guide member includes at least a press member for pressing the recording paper onto the capstan roller at the constant angle from the pressing position of the press roller about a rotational axis of the capstan roller. The supplemental guide member may be a pair of press members placed before and after the press roller for pressing the recording paper onto the capstan roller at positions having the constant angle from each other.

BRIEF DESCRIPTION OF THE DRAWINGS

The above and other objects and advantages of the present invention will become apparent from the following detailed description of the preferred embodiments when read in connection with the accompanying drawings, which are given by way of illustration only and thus are not limitative of the present invention, wherein like reference numerals designate like or corresponding parts throughout the several views, and wherein.

DETAILED DESCRIPTION OF THE PREFERRED EMBODIMENT

Figure 1:
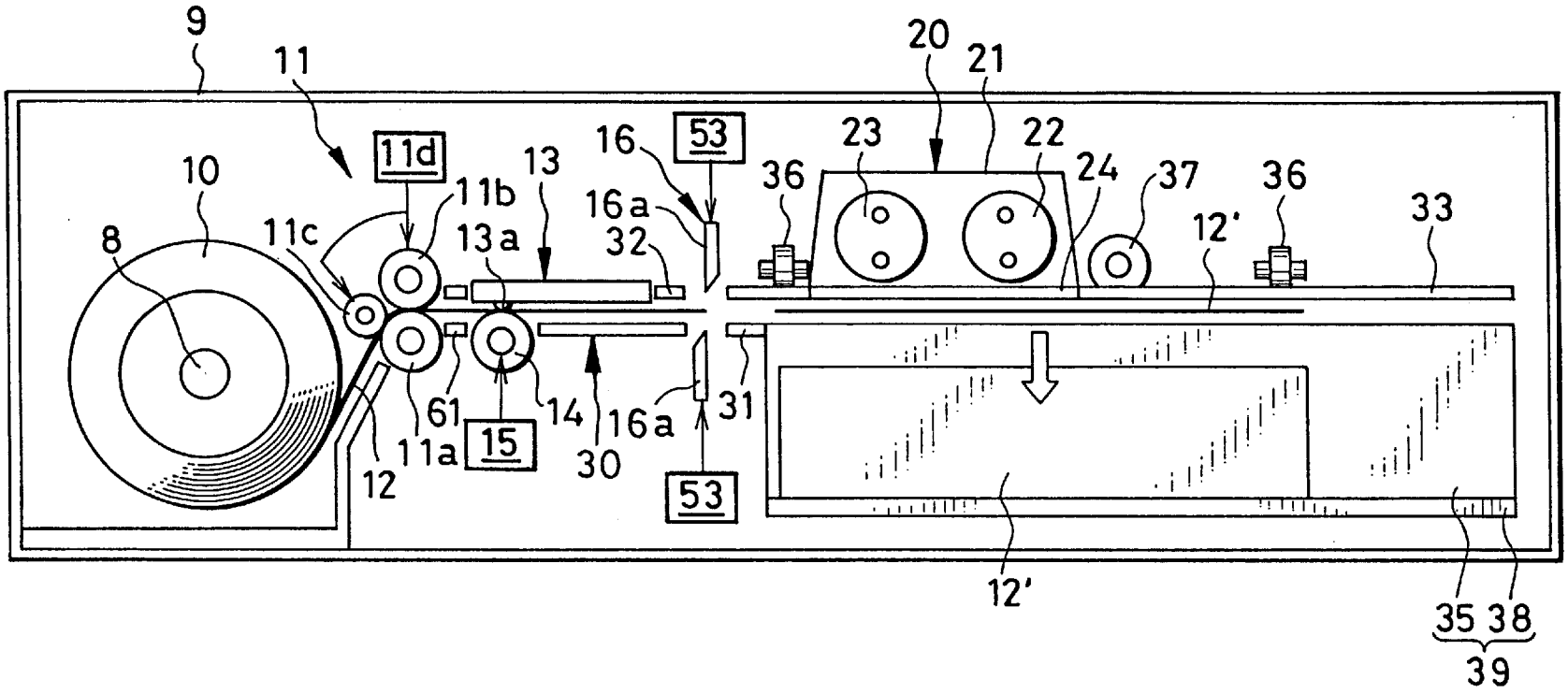
FIG. 1 is a schematic diagram illustrating a thermosensitive-type color printer according to an embodiment of the invention.

In a thermal printer shown in FIG. 1, a transport roller device 11 withdraws color thermosensitive recording paper 12 from a supply roll 10 which is mounted on a rotary shaft 8 in a cabinet 9. The transport roller device 11 is constituted of a capstan roller 11*a*, a main press roller 11*b*, a supplemental press roller 11*c* and a roller shift mechanism 11*d*. The roller shift mechanism 11*d* is provided for shifting the positions of the press rollers 11*b* and 11*c* between a pressing position contacting the capstan roller 11*a* and a retracted position away from the capstan roller 11*a*.

Figure 2A:
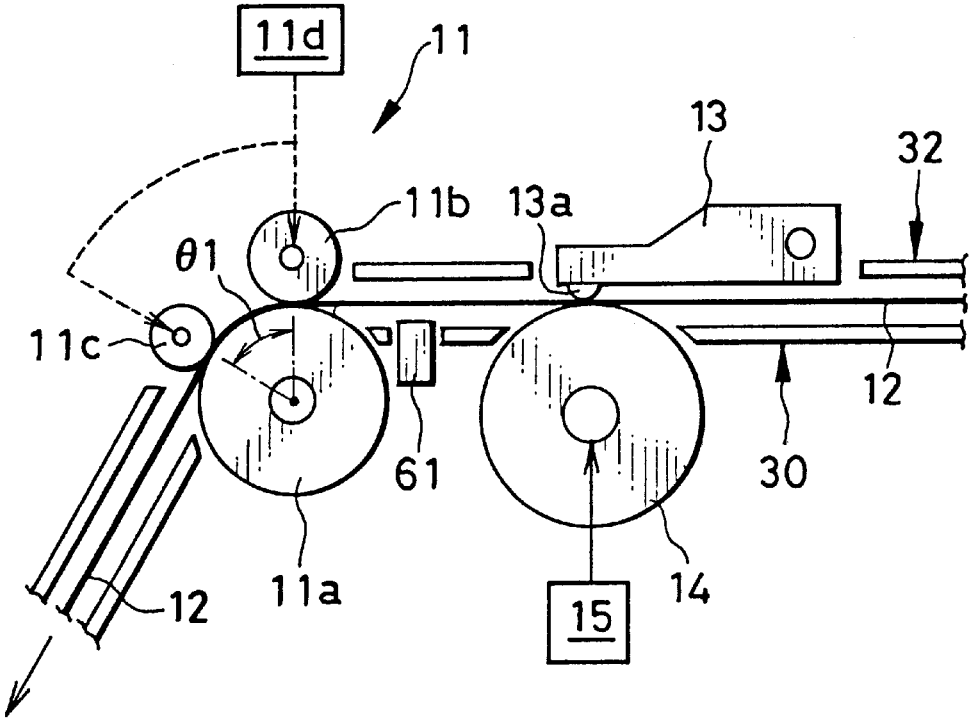
FIG. 2A is an explanatory view of a transport roller device of the printer shown in FIG. 1, transporting the recording paper in a recording direction.

As shown in FIG. 2A, the supplemental press roller 11*c* is disposed at an angle θ1 from the pressing position of the main press roller 11*b* about a rotational axis of the capstan roller 11*a*. Therefore, the recording paper 12 always turns around the capstan roller 11*a* through the angle θ1. The turn direction of the recording paper 12 around the capstan roller 11*a* is opposite to its winding direction into the supply roll 10, so that the curl of the recording paper 12 given by winding into the roll 10 is canceled through the transport roller device 11.

Figure 2B:
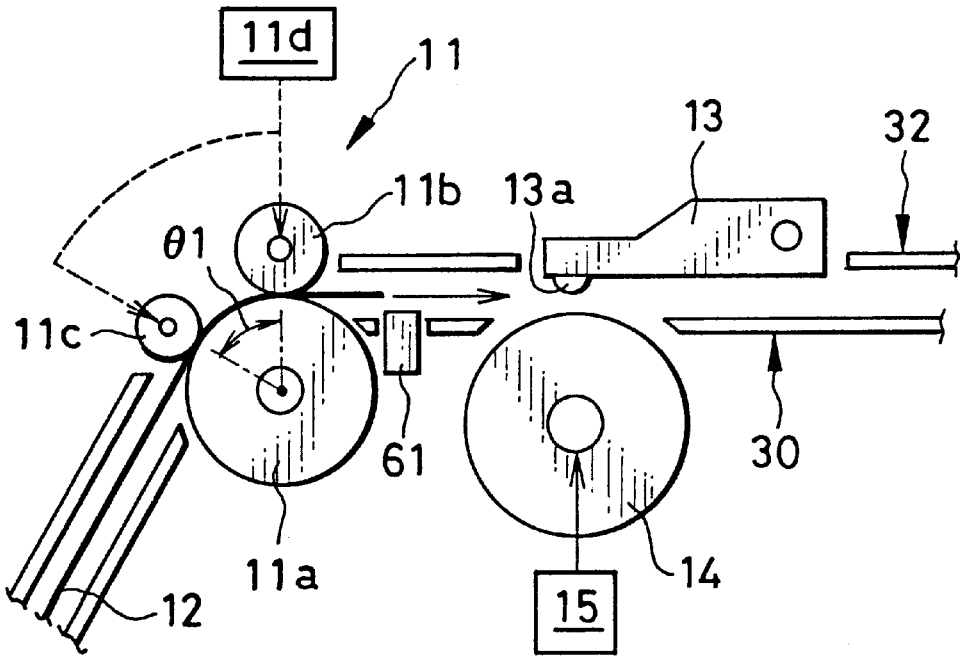
FIG. 2B is a schematic view of the transport roller device of the printer shown in FIG. 1, transporting the recording paper in a paper supply direction opposite to the recording direction.
Figure 3:
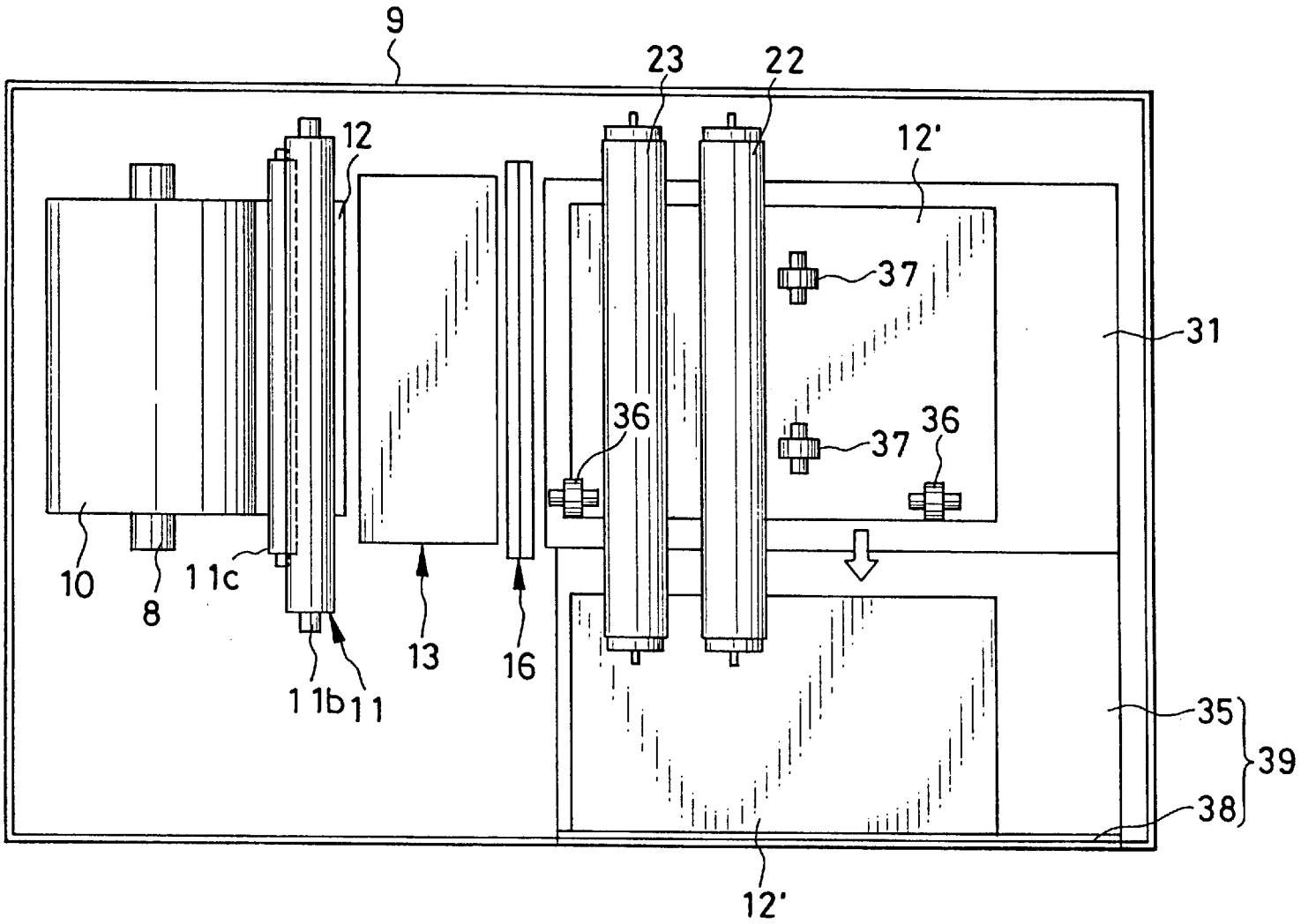
FIG. 3 is an explanatory top plan view of the printer shown in FIG. 1.

As shown in FIGS. 1 and 3, a thermal head 13 and a platen roller 14 are placed behind the transport roller device 11 in the paper supply direction, hereinafter referred to as a forward direction. According to this embodiment, the thermal head 13 is stationary, while the platen roller 14 is movable by an UP-DOWN mechanism 15 between a pressing position for pressing the recording paper 12 onto a heating element array 13*a* of the thermal head 13, as shown in FIG. 2A, and a retracted position away from the thermal head 13, as shown in FIG. 2B. It is, of course, possible to fix the position of the platen roller 14 and make the thermal head 13 movable toward and away from the platen roller 14.

The heating element array 13*a* consists of a great number of heating elements aligned in an axial direction of the platen roller 14, so that the image is recorded line by line while the recording paper 12 is moved through between the thermal head 13 and the platen roller 14.

The thermosensitive recording paper 12 has yellow, magenta and cyan coloring layers sequentially overlaid on a support material in order from the top. The top yellow coloring layer has the highest heat sensitivity, and is fixable by visible violet rays of 420 nm. The second magenta coloring layer is fixable by ultraviolet rays of 365 nm. Three color frames of a full-color image are sequentially recorded in a recording area by heat-developing these coloring layers.

An optical fixing device 20 is placed behind the thermal head 13 in the forward direction. The optical fixing device 20 is constituted of a reflector 21, a yellow fixing lamp 22, a magenta fixing lamp 23, and a transparent guide plate 24. The yellow fixing lamp 22 projects visible violet rays of about 420 nm to fix the yellow coloring layer after having a yellow frame recorded therein, to prevent the yellow coloring layer from developing during the next magenta recording. The magenta fixing lamp 23 projects ultraviolet rays of about 365 nm to fix the magenta coloring layer after having a magenta frame recorded therein, to prevent the magenta coloring layer from developing during the next cyan recording. The transparent guide plate 24 is to guide the recording paper 12 through the optical fixing device 20 without contacting the reflector 21 and the fixing lamps 22 and 23. The transparent guide plate 24 may be made of acrylic resin or other plastic resin or glass. The transparent guide plate 24 may be omitted.

A cutter 16 having a pair of edges 16*a* is disposed between the thermal head 13 and the optical fixing device 20, to cut the individual recording area off the recording paper 12 after having the full-color image recorded thereon.

Lower paper guide plates 30 and 31, and upper paper guide plates 32 and 33 are provided for forming a passageway for the recording paper 12 from the supply roll 10 to the optical fixing device 20. The lower paper guide plate 30 is disposed between the supply roll 10 and the cutter 16, and has openings for the capstan roller 11*a* and the platen roller 14. The upper paper guide plate 32 is a counterpart of the lower paper guide plate 30, and has openings for the main press roller 11*b*, the supplemental press roller 11*c* and the thermal head 13.

The lower paper guide plate 31 is placed behind the cutter 16 in the forward direction. A paper slide plate 35 is joined to one side of the lower paper guide plate 31, as is shown in FIG. 3. The lower paper guide plate 31 has openings for ejection roller pairs 36 and 37. The upper paper guide plate 33 is a counterpart of the lower paper guide plate 31, and has openings for the ejection roller pairs 36 and 37 and an opening for the optical fixing device 20.

As shown in FIG. 1, the paper slide plate 35 inclines downward from the lower paper guide plate 31. Each sheet 12' cut by the cutter 16 and ejected from the lower paper guide plate 31 by the ejection roller pairs 36 slides down to a paper stopper 38 which is formed along the bottom side of the paper slide plate 35. The paper stopper 38 and the paper slide plate 35 constitute a paper ejection tray 39.

The ejection roller pairs 37 are provided behind the optical fixing device 20, for conveying the sheet 12' in the forward direction to a position where the sheet 12' is ejected laterally down to the paper ejection tray 39 by the ejection roller pairs 36. The ejection roller pairs 36 are disposed before and behind the optical fixing device 20. The ejection roller pairs 36 and 37 are respectively retracted from the paper passageway by roller shift mechanisms 36*c* and 37*c*, as shown in the circuit diagram of FIG. 4, except when to eject the sheet 12'.

Figure 4:
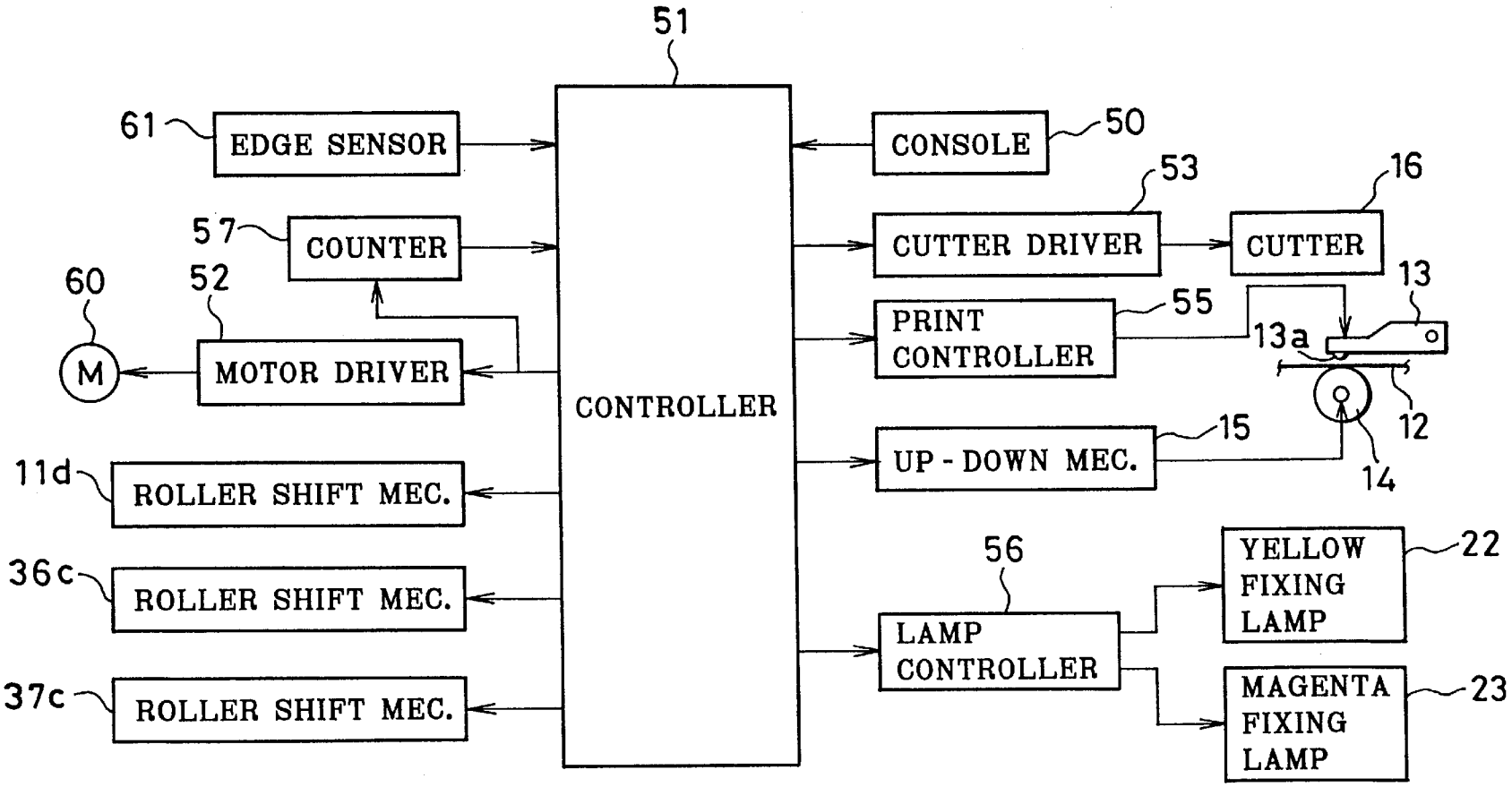
FIG. 4 is a block diagram of the printer shown in FIG. 1.

In FIG. 4, a console 50 is provided with a print start key and other keys to input various commands in a controller 51. The controller 51 controls a motor driver 52, a cutter driver 53, the UP-DOWN mechanism 15, a print controller 55, a lamp controller 56, a counter 57 and the roller shift mechanisms 11*c*, 36*c* and 37*c*.

The controller 51 sends a rotational direction signal and drive pulses to the driver 52. The driver 52 rotates a pulse motor 60 forward or reversely to rotate the capstan roller 11*a* and drive rollers of the ejection roller pairs 36 and 37 in the forward or the reverse direction, respectively. The counter 57 starts counting each time it receives a paper edge signal from an edge sensor 61. The edge sensor 61 is disposed between the transport roller device 11 and the thermal head 13, to detect the edge of the recording paper 12. During the forward rotation of the pulse motor 60, the counter 57 counts up. During the reverse rotation of the pulse motor 60, the counter 57 counts down.

The cutter driver 53 drives cutting edges 16*a* of the cutter 16 to cut the recording paper 12 into individual sheet 12'. The print controller 55 is constituted of three color frame memories and a head driver to drive the heating elements of the thermal head 13 in accordance with three color image data stored in the frame memories. The lamp controller 56 controls lighting of the fixing lamps 22 and 23.

Figure 5:
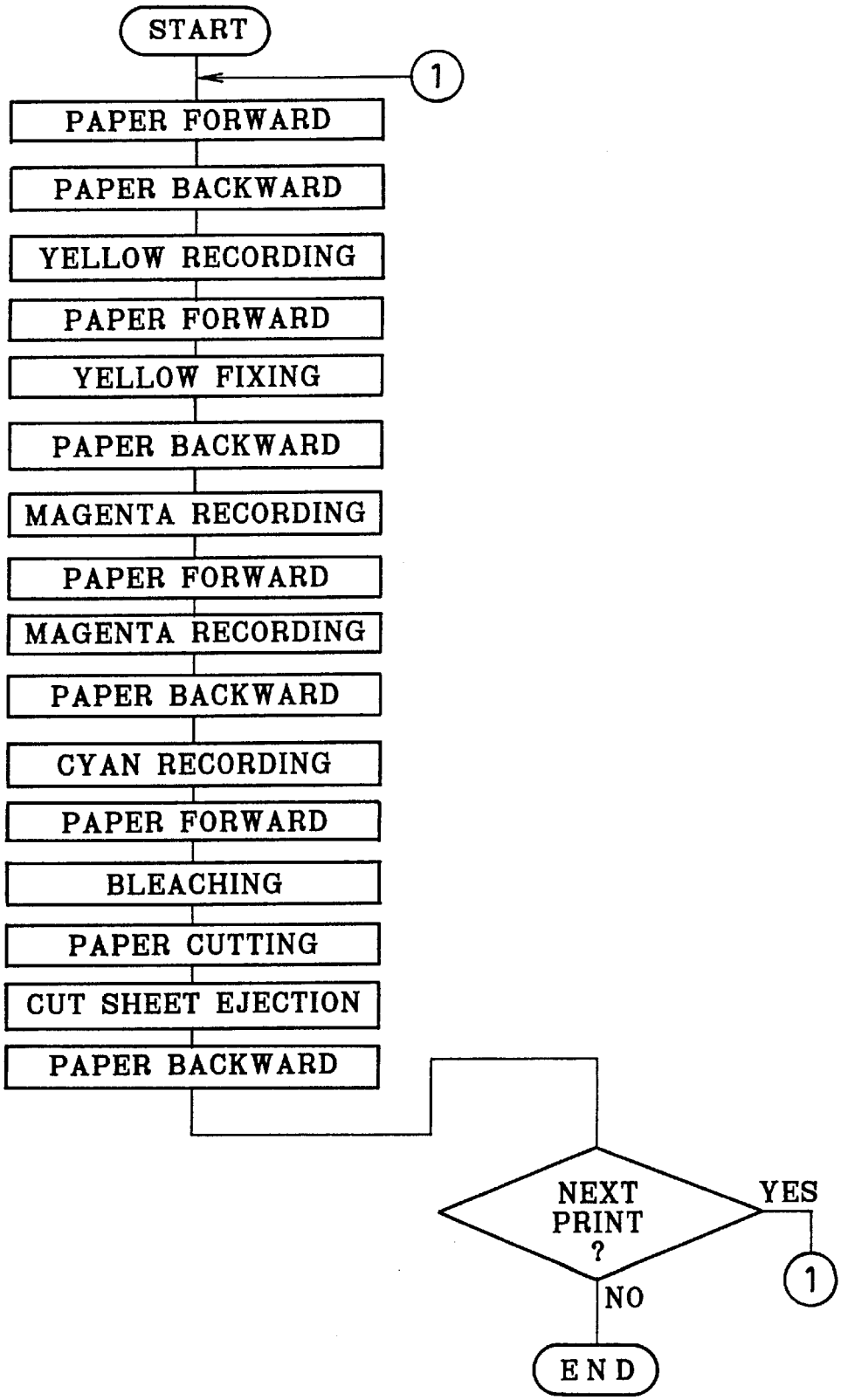
FIG. 5 is a flow chart illustrating the operation of the printer shown in FIG. 1.

Now the operation of the thermal printer having the above configuration will be described with reference to a flow chart shown in FIG. 5.

After image data of a full-color image is picked up, the print start key of the console 50 is operated. Then, the controller 51 drives the pulse motor 60 forward through the driver 52, to transport the recording paper 12 out from the supply roll 10 through the transport roller device 11. When the leading edge of the recording paper 12 goes past the edge sensor 61, the controller 51 starts counting up the drive pulses to the pulse motor 60. With reference to the count of the counter 57, the controller 51 detects the position of the recording paper 12 relative to the heating element array 13, and stops the forward movement of the recording paper 12 when a recording area has moved past the heating element array 13*a*.

Next, the controller 51 drives the pulse motor 60 reversely to transport the recording paper 12 backward, and causes the counter 57 to count down. With reference to the count of the counter 57, the controller 51 detects the position of the recording paper 12 relative to the thermal head 13, and drives the thermal head 13 to record an yellow frame line after line in the recording area. After the yellow recording, the backward movement of the recording paper 12 is terminated when the edge sensor 61 detects the leading edge of the recording paper 12. Simultaneously, the controller 51 resets the counter 57. Then, the controller 51 drives the transport roller device 11 to transport the recording paper 12 in the forward direction until the whole recording area is exposed to the rays from the yellow fixing lamp 22, to fix the yellow frame recorded in the recording area. After the optical fixing of yellow is accomplished, the transport roller device 11 transports the recording paper 12 backward, while the thermal head 13 records a magenta frame line after line in the recording area.

The magenta frame is optically fixed by the magenta fixing lamp 23 in the same way as the yellow frame. Because the magenta fixing lamp 23 is placed before the yellow fixing lamp 22 in the forward direction, the forward movement of the recording paper 12 necessary for the magenta fixing is less than that for the yellow fixing. After the optical fixing of the magenta coloring layer is accomplished, the transport roller device 11 transports the recording paper 12 backward, while the thermal head 13 records a cyan frame line by line in the recording area. The cyan coloring layer is not optically fixable and its heat-sensitivity is so low that it would not color under environmental temperature, so that it is unnecessary to fix the cyan frame. However, the magenta fixing lamp 23 projects the ultraviolet rays toward the recording paper 12 to bleach yellowish-white blanks inside and outside the recording area.

During the bleaching, the controller 51 stops the recording paper 12 when a cutting line of the recording paper 12 is placed at the cutter 16. The cutter 16 cuts the recording paper 12 along the cutting line, and the roller shift mechanism 37*c*is driven to nip a cut sheet 12' between the ejection rollers 37. When the cut sheet 12' is moved by the ejection rollers 37 to the ejection position, the roller shift mechanism 37*c*is driven to release the sheet 12' from the ejection rollers 37. Instead, the roller shift mechanism 36*c* is driven to nip the sheet 12' between the ejection rollers 36. Thereafter, the ejection rollers 36 rotate to eject the sheet 12' laterally to the paper ejection tray 39.

Since the recording paper 12 turns around the capstan roller 11*a* through the given angle θ1 both in the forward direction and in the backward direction, even if the recording paper 12 curls during the thermal recording, the transporting amount of the recording paper 12 per a rotational angle of the capstan roller 11*a* will not be affected by the curling in either transporting direction. Therefore, color registration failures are minimized.

Figure 6:
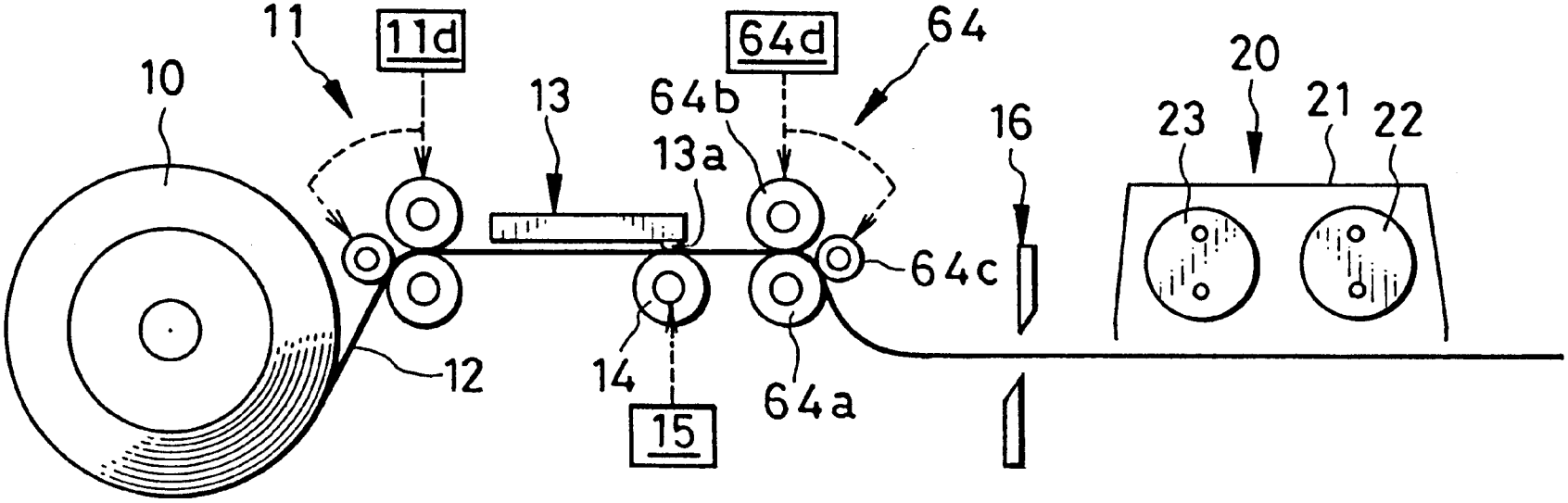
FIG. 6 is a thermosensitive-type color printer according to a another embodiment of the invention.

The same effect is achievable by a second embodiment shown in FIG. 6, wherein a second transport roller device 64 is provided behind a thermal head 13 in addition to a transport roller device 11 disposed before the thermal head 13 in the forward direction. Furthermore, the thermal head 13 is oriented reversely to the first embodiment, assuming that the thermal head 13 has a horizontally extending body in either embodiment. The second transport roller device 64 is constituted of a capstan roller 64*a*, a main press roller 64*b*, a supplemental press roller 64*c* and a roller shift mechanism 64*d* for shifting the press rollers 64*b* and 64*c* to or from the capstan roller 64*a*. Because of the press rollers 64*b* and 64*c*, the recording paper 12 turns around the capstan roller 64*a* through a given angle in either transporting direction.

Figure 7:
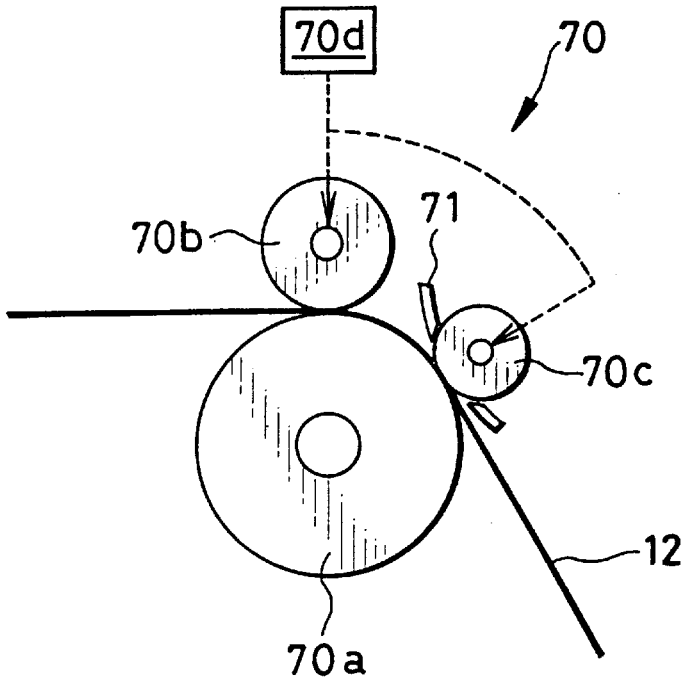
FIG. 7 is a schematic view of a transport roller device according to a third embodiment of the invention.
Figure 8:
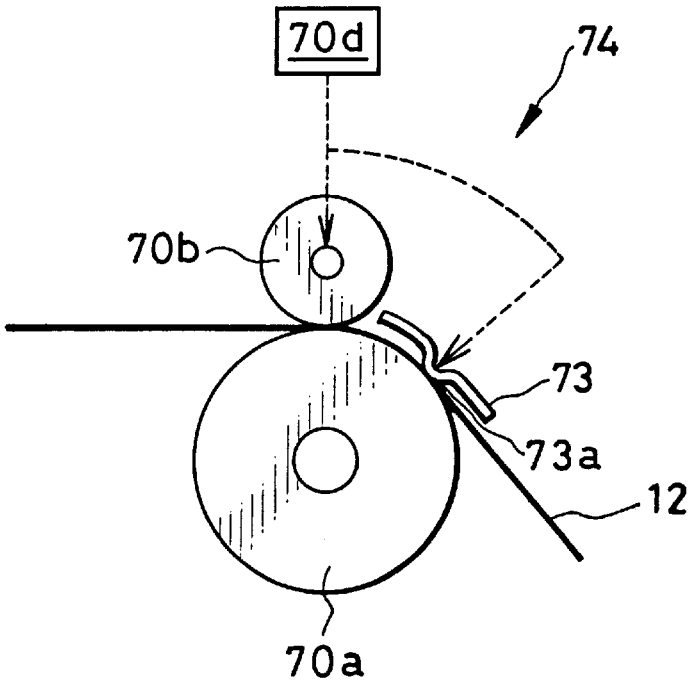
FIG. 8 is a schematic view of a transport roller device according to a fourth embodiment of the invention.

According to another embodiment, a transport roller device 70 is provided with a guide member 71 in combination with a supplemental press roller 70*c*, as shown in FIG. 7, wherein 70*a*, 70*b* and 70*d* designate a capstan roller, a main press roller and a roller shift mechanism respectively. It is possible to use a pressing guide plate 73 having a pressing ridge 73*a* instead of the supplemental press roller 70*c* and the guide plate 71, as shown by a transport roller device 74 in FIG. 8. The pressing ridge 73*a* should have the surface to contact the recording paper 12 rounded or arched in both transporting directions for smooth guiding of the recording paper 12.

Figure 9:
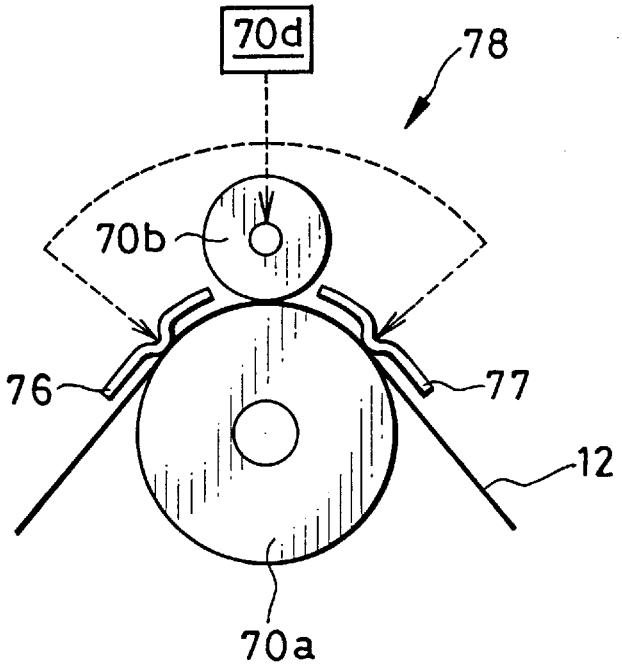
FIG. 9 is a schematic view of a transport roller device according to a fifth embodiment of the invention.
Figure 10:
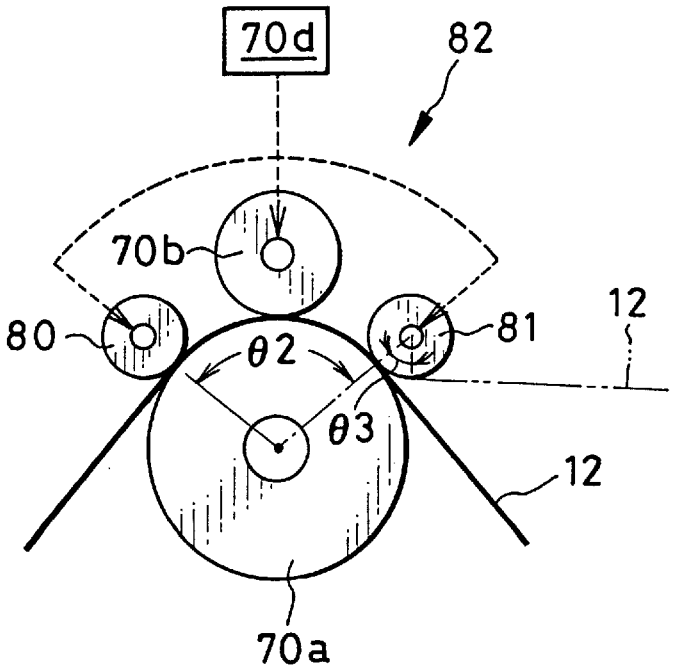
FIG. 10 is a schematic view of a transport roller device according to a sixth embodiment of the invention.

It is also possible to dispose pressing guide plates 76 and 77 before and behind a main press roller 70*b* to maintain the turn angle of the recording paper 12 around a capstan roller 70*a* unchanged, as shown by a transport roller device 78 in FIG. 9. It is of course possible to dispose supplemental press rollers 80 and 81 before and behind a main press roller 70*b* to keep the turn angle of the recording paper 12 around a capstan roller 70*a* at a constant value θ2, as shown by a transport roller device 82 in FIG. 10. Although it is not shown but possible to suspend an endless belt between two rollers such that a portion of the endless belt contacts an outer peripheral portion of a capstan roller and thus keeps the recording paper 12 in contact with the outer peripheral portion of the capstan roller.

Because the supplemental press roller is pressed against the capstan roller through the recording paper 12 in the above embodiments, the supplemental press rollers rotate synchronously with the capstan roller 70*a* in the pressing position. That is, the supplemental press roller itself applies a transporting motion to the recording paper 12. In that case, if the recording paper 12 turns around the supplemental press roller, as shown by phantom lines in FIG. 10, the motion applied from the supplemental press roller 81 to the recording paper 12 would vary when the turn angle θ3 around the supplemental press roller 81 varies. As result, transporting accuracy is lowered. As the supplemental press roller is smaller in diameter than the capstan roller, variation in the turn angle θ3 around the supplemental press roller is correspondingly small compared with potential variation in the turn angle around the capstan roller that could occur without any supplemental press or guide device beside the main press roller, the following embodiments are useful for preventing the variation in the turn angle θ3.

Figure 11:
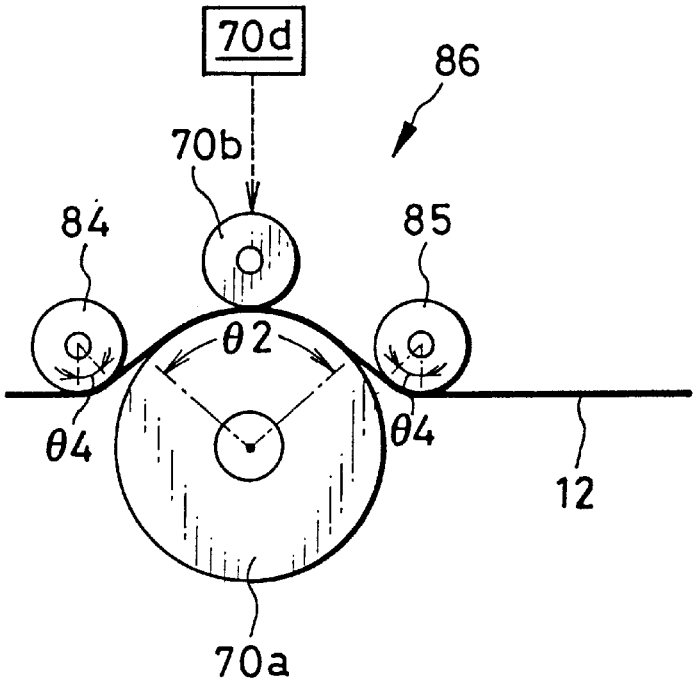
FIG. 11 is a schematic view of a transport roller device according to a seventh embodiment of the invention.

In a transport roller device 86 shown in FIG. 11, guide rollers 84 and 85 are disposed away from a capstan roller 70*a* and before and behind a main press roller 70*b*. The guide rollers 84 and 85 do not apply any transporting motion to the recording paper 12, but just rotate along with the movement of the recording paper 12. According to this configuration, variation in turn angle θ4 of the recording paper 12 around the guide roller 84 or 85 has no effect on the transportation of the recording paper 12, while the turn angle θ2 around the capstan roller 70*a* is maintained unchanged. Therefore, more accurate color registration is achieved.

Figure 12:
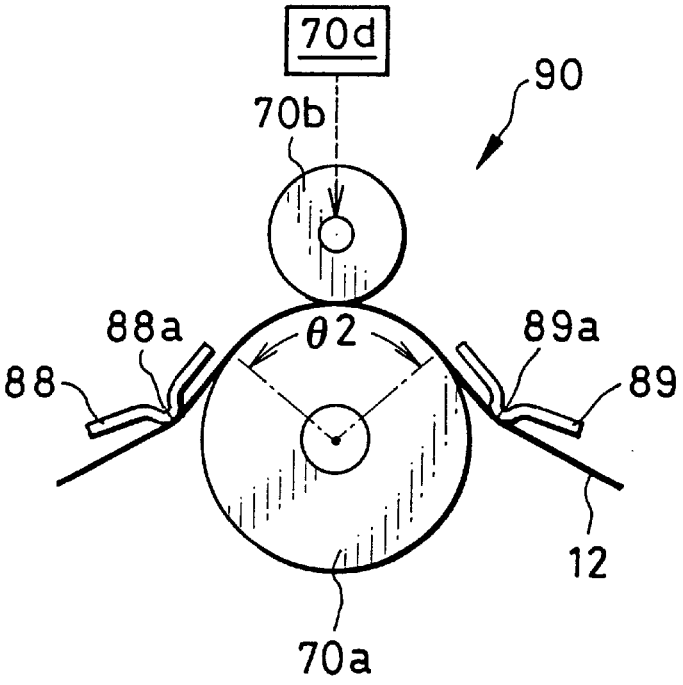
FIG. 12 is a schematic view of a transport roller device according to an eighth embodiment of the invention.

Instead of the guide roller 84 and 85, it is possible to provide guide plates 88 and 89 each having a round or arched guide surface 88*a* and 89*a*, as shown by a transport roller device 90 in FIG. 12.

Figure 13:
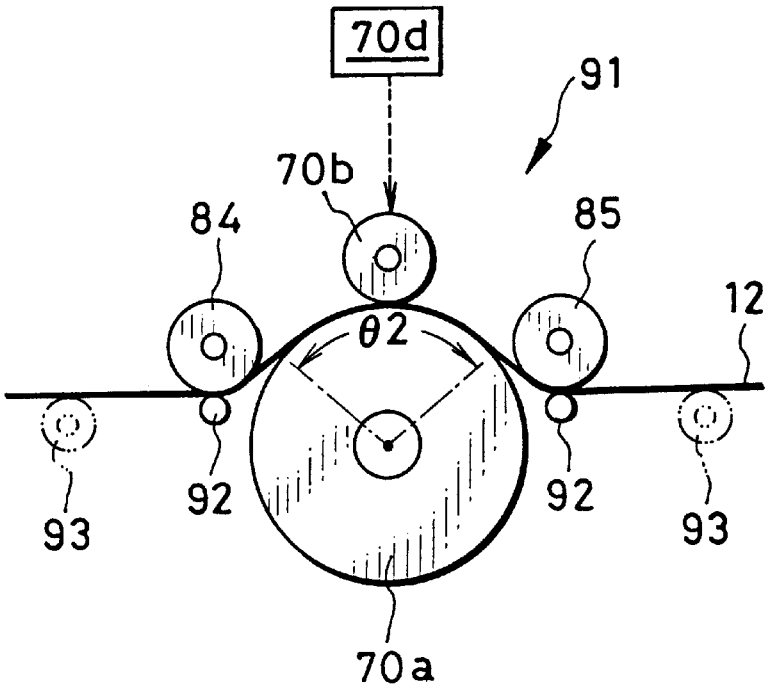
FIG. 13 is a schematic view of a transport roller device according to a ninth embodiment of the invention.

The support material of the thermosensitive color recording paper 12 having the above layered construction has so large stiffness that the recording paper 12 is kept in contact with the guide rollers 84 and 85 or the guide plates 88 and 89 due to its own stiffness. However, in case the recording paper 12 is less stiff, providing supplemental press rollers 92 in contact with the guide rollers 84 and 85 as shown by a transport roller device 91 in FIG. 13, is preferable in order to make sure to keep the recording paper 12 in contact with the guide rollers 84 and 85. For the same reason, the same supplemental press rollers 92 may also be provided in contact with the guide plates 88 and 89.

If there is no room for providing the supplemental press rollers 92, it is possible to provide supplemental guide rollers 93 instead of the press rollers 92, as is shown by phantom lines in FIG. 13.

Figure 14:
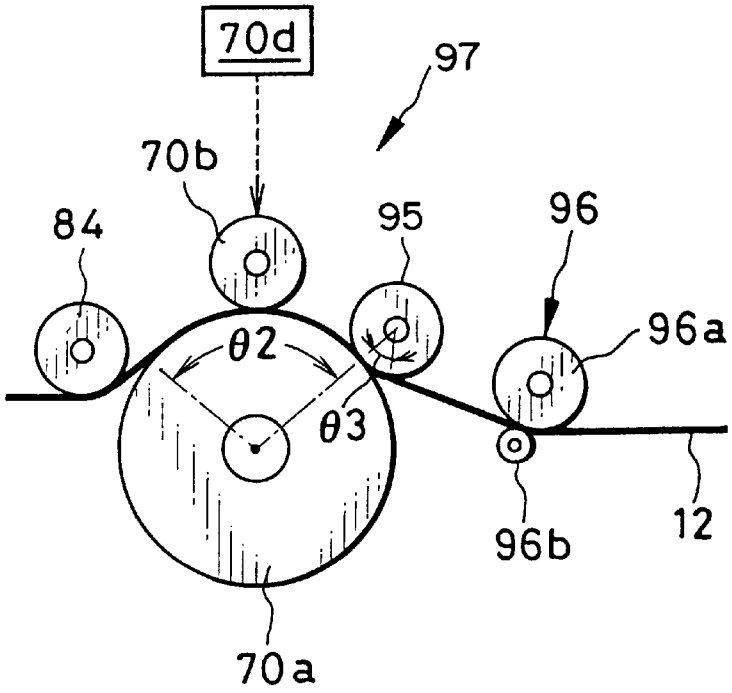
FIG. 14 is a schematic view of a transport roller device according to another embodiment of the invention.

FIG. 14 shows a transport roller device 97 according to another embodiment, wherein a guide roller 84 is placed before a main press roller 70*b*, and a supplemental press roller 95 is placed behind the main press roller 70*b* with respect to the forward direction, so as to maintain the turn angle θ2 of the recording paper 12 around a capstan roller 70*a* unchanged. Also, a supplemental guide roller device 96 is placed behind the supplemental press roller 95, to maintain the turn angle θ3 around the supplemental press roller 95 unchanged. Although the supplemental guide roller device 96 consists of a guide roller 96*a* and a press roller 96*b* in FIG. 14, it is possible to omit the press roller 96*b* when the recording paper 12 is maintained in contact with the guide roller 96 without the press roller 96*b*.

Figure 15:
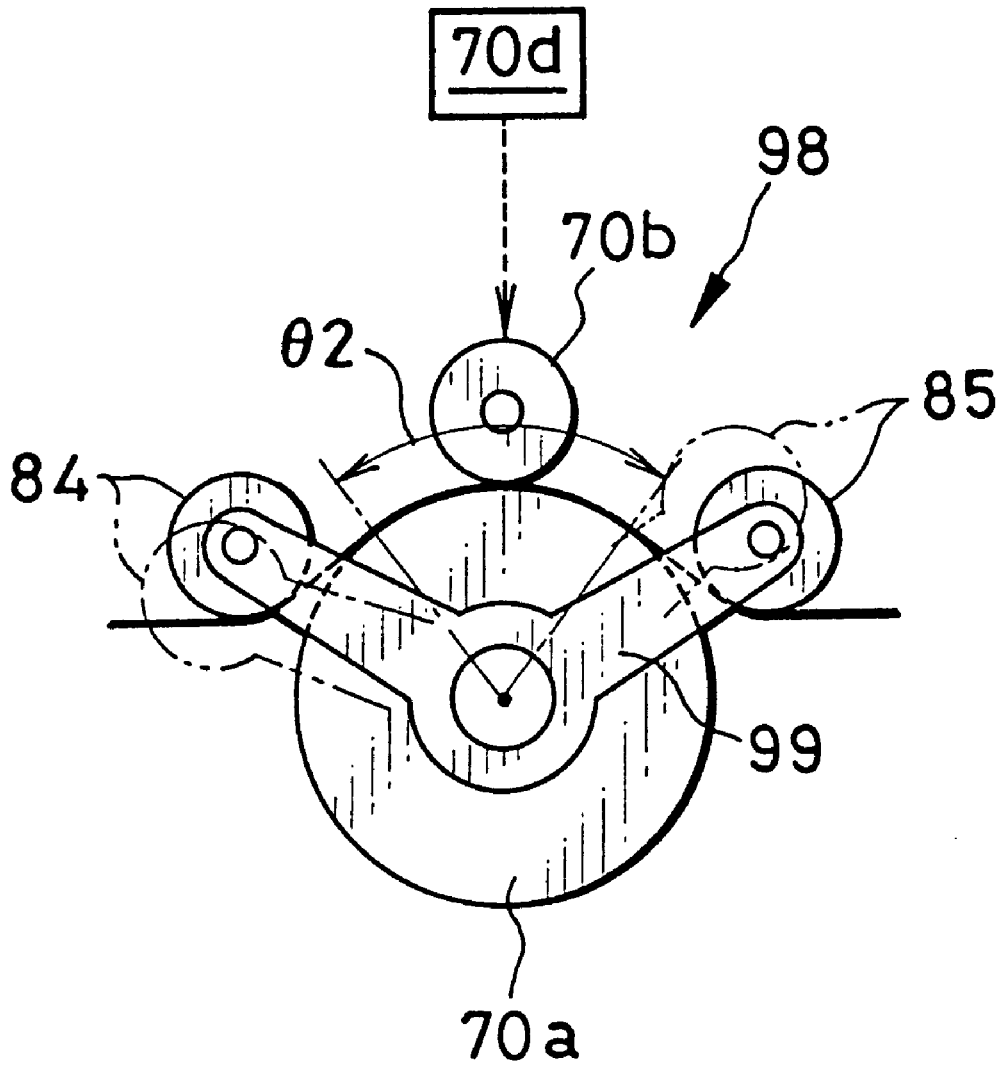
FIG. 15 is a schematic view of a transport roller device according to a further embodiment of the invention.

The guide rollers 84 and 85 may be mounted rotatably to a stationary frame which is fixed in position relative to the capstan roller 70*a*. In alternative, it is possible to mount the guide rollers 84 to a swinging frame 99 as shown by a transport roller device 98 in FIG. 15. The swinging frame 99 can swing about the same axis as the capstan roller 70*a*, and supports the guide rollers 84 at distal ends of its radial arms which form a predetermined constant angle. Because the swinging frame 99 swings in accordance with any variation in tension of the recording paper 12, the variation in tension of the recording paper 12 is retained. Because the angle between the guide rollers 84 and 85 is maintained constant even when the swinging frame 99 swings, the turn angle θ2 of the recording paper 12 around the capstan roller 70*a* is maintained unchanged.

It is possible to mount the guide plates 88 and 89 of FIG. 12 to the swinging frame 99 in replace of the guide rollers 84 and 85. It is also possible to use a swinging frame for supporting the supplemental press rollers 80 and 81 of FIG. 10. The swinging frame 99 is preferably biased by a spring force to stay in a neutral position. But it is possible to mount the frame 99 to be able to swing freely about the axis.

It is possible to place a single guide roller away from a capstan roller before or after a main press roller, to keep the recording paper in contact with the periphery of the capstan roller at a constant angle.

The present invention is applicable to a printer that uses cut paper sheets in place of the continuous recording paper 12. The construction for paper ejection of the above embodiment is not limitative to the present invention. The arrangement of the thermal head 13, the cutter 16 and the optical fixing device 20 along the paper passageway may also be changed appropriately. The platen roller 14 may be replaced by a platen plate. It is possible to provide a shutter device in combination with the optical fixing device 20, for controlling the light projection time onto the recording paper 12 and thus equalizing the light quantity applied to the entire recording area. The present invention is also applicable to a thermal transfer type color printer.

Thus, the present invention is not to be limited to the above embodiments but, on the contrary, various modifications of the present invention will be possible to those skilled in the art without departing from the scope of claims attached hereto.

What is claimed is:

1. A color thermal printer for recording a full-color image in a frame sequential fashion, wherein recording paper is transported through a path alternately in a recording direction and in the opposite direction, and a thermal head is disposed in the path to record one color frame during one transport of the recording paper in the recording direction, the color thermal printer comprising:

a capstan roller driven by a motor or an actuator;

a press roller for pressing the recording paper onto the capstan roller and rotating together with the capstan roller to transport the recording paper along the path; and a supplemental guide member disposed around the capstan roller, for keeping the recording paper in contact with a peripheral surface of the capstan roller through a constant angle about a rotational axis of the capstan roller in either transporting direction, to thereby maintain a paper transporting amount per a rotational angle of the capstan roller unchanged, wherein the supplemental guide member comprises at least a roller which is placed before or after the press roller in the paper transport path, the roller being spaced away from the capstan roller.

2. The color thermal printer according to claim 1, wherein the supplemental guide member comprises a pair of rollers placed before and after the press roller in the paper transport path, at least one of the rollers being spaced away from the capstan roller.

3. A color thermal printer for recording a full-color image in a frame sequential fashion, wherein recording paper is transported through a path alternately in a recording direction and in the opposite direction, and a thermal head is disposed in the path to record one color frame during one transport of the recording paper in the recording direction, the color thermal printer comprising:

a capstan roller driven by a motor or an actuator;

a press roller for pressing the recording paper onto the capstan roller and rotating together with the capstan roller to transport the recording paper along the path; and a supplemental guide member disposed around the capstan roller, for keeping the recording paper in contact with a peripheral surface of the capstan roller through a constant angle about a rotational axis of the capstan roller in either transporting direction, to thereby maintain a paper transporting amount per a rotational angle of the capstan roller unchanged, wherein the supplemental guide member comprises at least one guide plate placed before or after the press roller in the paper transport path for pressing the recording paper against the capstan roller, the guide plate having a pressing surface projecting therefrom which is rounded or arched in the transporting directions, said recording paper being pressed between said pressing surface of said guide plate and said capstan roller.

4. A color thermal printer for recording a full-color image in a frame sequential fashion, wherein recording paper is transported through a path alternately in a recording direction and in the opposite direction, and a thermal head is disposed in the path to record one color frame during one transport of the recording paper in the recording direction, the color thermal printer comprising:

a capstan roller driving by a motor or an actuator;

a press roller for pressing the recording paper onto the capstan roller and rotating together with the capstan roller to transport the recording paper along the path; and a supplemental guide member disposed around the capstan roller, for keeping the recording paper in contact with a peripheral surface of the capstan roller through a constant angle about a rotational axis of the capstan roller in either transporting direction, to thereby maintain a paper transporting amount per a rotational angle of the capstan roller unchanged, wherein the supplemental guide member comprises a pair of press plates placed before and after the press roller for pressing the recording paper onto the capstan roller between said press plates and said capstan roller at positions having the constant angle from each other about the rotational axis of the capstan roller.

5. The color thermal printer according to claim 4, wherein the press plates each have a pressing surface protecting therefrom and rounded or arched in the transporting directions, said recording paper being pressed between said pressing surface and said capstan roller.

6. The color thermal printer according to claim 4, wherein the press members are mounted movable between a pressing position for pressing the recording paper onto the capstan roller and a retracted position away from the capstan roller.

7. The color thermal printer according to claim 4, wherein the recording paper is withdrawn from a supply roll that is loaded in the paper supply section, and is turned around the capstan roller in a direction opposite to the winding direction of the recording paper in the supply roll, so as to straighten the recording paper before recording.

8. The color thermal printer according to claim 4, wherein the recording paper is color thermosensitive recording paper having a first thermosensitive coloring layer for developing a first color, a second thermosensitive coloring layer for developing a second color and a third thermosenstive coloring layer for developing a third color, the first to third thermosensitive coloring layers being sequentially overlaid on a support material in order from an obverse surface of the recording paper on which the thermal head contacts, the first thermosensitive coloring layer having a highest heat sensitivity, the first and second thermosensitive coloring layers being fixable by rays of a first wavelength range and a second wavelength range respectively.

9. The color thermal printer according to claim 8, wherein the thermal head records frames of the first to third colors in order from the first to the third, and wherein the thermal printer further comprises a fixing unit for radiating rays of the first wavelength range to the first thermosensitive coloring layer after having the first color frame recorded therein, and for radiating rays of the second wavelength range to the second thermosensitive coloring layer after having the second color frame recorded therein.

10. A color thermal printer for recording a full-color image in a frame sequential fashion, wherein recording paper is transported through a path alternately in a recording direction and in the opposite direction, and a thermal head is disposed in the path to record one color frame during one transport of the recording paper in the recording direction, the color thermal printer comprising:

a capstan roller driving by a motor or an actuator;

a press roller for pressing the recording paper onto the capstan roller and rotating together with the capstan roller to transport the recording paper along the path; and a supplemental guide member disposed around the capstan roller, for keeping the recording paper in contact with a peripheral surface of the capstan roller through a constant angle about a rotational axis of the capstan roller in either transporting direction, to thereby maintain a paper transporting amount per a rotational angle of the capstan roller unchanged, wherein the supplemental guide member comprises a pair of press members placed before and after the press roller for pressing the recording paper onto the capstan roller at positions having the constant angle from each other about the rotational axis of the capstan roller, and wherein the press members are mounted to a frame that can swing about the rotational axis of the capstan roller together with the press members.

11. The color thermal printer according to claim 10, wherein the press members are rollers.

12. The color thermal printer according to claim 10, wherein the recording paper is withdrawn from a supply roll that is loaded in the paper supply section, and is turned around the capstan roller in a direction opposite to the winding direction of the recording paper in the supply roll, so as to straighten the recording paper before recording.

13. The color thermal printer according to claim 10, wherein the recording paper is color thermosensitive recording paper having a first thermosensitive coloring layer for developing a first color, a second thermosensitive coloring layer for developing a second color and a third thermosenstive coloring layer for developing a third color, the first to third thermosensitive coloring layers being sequentially overlaid on a support material in order from an obverse surface of the recording paper on which the thermal head contacts, the first thermosensitive coloring layer having a highest heat sensitivity, the first and second thermosensitive coloring layers being fixable by rays of a first wavelength range and a second wavelength range respectively.

14. The color thermal printer according to claim 13, wherein the thermal head records frames of the first to third colors in order from the first to the third, and wherein the thermal printer further comprises a fixing unit for radiating rays of the first wavelength range to the first thermosensitive coloring layer after having the first color frame recorded therein, and for radiating rays of the second wavelength range to the second thermosensitive coloring layer after having the second color frame recorded therein.

15. A paper transporting method for a color thermal printer having a thermal head for recording a full-color image in a frame sequential fashion, the method comprising the steps of:

nipping recording paper between a capstan roller and a press roller rotating together with the capstan roller;

rotating the capstan roller to transport recording paper through a path in one direction, while the thermal head is recording one color frame in a recording area on the recording paper;

rotating the capstan roller to transport recording paper through the path in the opposite direction to move back the recording area to a position for the thermal head to start recording the next color frame; and keeping the recording paper in contact with a peripheral surface of the capstan roller through a constant angle in either transporting directions by providing a supplemental guide member around the capstan roller, to thereby maintain a paper transporting amount per a rotational angle of the capstan roller unchanged, wherein the supplemental guide member comprises a pair of press plates placed before and after the press roller for pressing the recording paper onto the capstan roller between said press plates and said capstan roller at positions having the constant angle from each other about the rotational axis of the capstan roller.

* * * * *